US011414298B2

(12) United States Patent
Shi

(10) Patent No.: US 11,414,298 B2
(45) Date of Patent: Aug. 16, 2022

(54) GOVERNOR ASSEMBLY AND ELEVATOR SYSTEM

(71) Applicant: Otis Elevator Company, Farmington, CT (US)

(72) Inventor: Zhengbao Shi, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 944 days.

(21) Appl. No.: 16/174,457

(22) Filed: Oct. 30, 2018

(65) Prior Publication Data

US 2019/0127180 A1 May 2, 2019

(30) Foreign Application Priority Data

Oct. 30, 2017 (CN) ..... 201711031853.1

(51) Int. Cl.
*B66B 5/04* (2006.01)
*B66B 1/30* (2006.01)
*B66B 5/18* (2006.01)

(52) U.S. Cl.
CPC ..... *B66B 5/044* (2013.01); *B66B 1/30* (2013.01); *B66B 5/18* (2013.01)

(58) Field of Classification Search
CPC ..... B66B 5/044; B66B 1/32; B66B 5/0031; B66B 5/04; B66B 5/0018; B66B 1/36
See application file for complete search history.

(56) References Cited

U.S. PATENT DOCUMENTS 5,226,508 A * 7/1993 Ericson ..... B66D 5/14 187/254
5,533,712 A * 7/1996 Fujikawa ..... B66D 1/58 254/362
8,136,795 B2 * 3/2012 Dube ..... B66B 5/044 254/394
8,453,799 B2 * 6/2013 Muller ..... B66B 5/044 187/287
8,931,598 B2 1/2015 Aguado et al.
(Continued)

FOREIGN PATENT DOCUMENTS

CN 102892699 B 12/2014
CN 104773628 A 7/2015
(Continued)

*Primary Examiner* — Marlon T Fletcher
(74) *Attorney, Agent, or Firm* — Cantor Colburn LLP

(57) ABSTRACT

A governor assembly and an elevator system. The governor assembly includes: a stationary shaft; a sheave arranged on the stationary shaft and rotatable on the stationary shaft; a core ring arranged on one side of the sheave on the stationary shaft and associated with a safety apparatus; and a lock mechanism including a plurality of rockers, wherein each rocker includes a first end pivotably connected to the sheave and a second end connected to a respective roller, the plurality of rockers are connected by connecting rods such that the plurality of rockers can be pivoted synchronously between a first position where the respective roller is separated from the core ring and a second position where the respective roller is jointed to the core ring, and in the second position, each roller rotates along with the sheave to drive the core ring, thus triggering the mounting apparatus.

21 Claims, 12 Drawing Sheets

(56) References Cited

U.S. PATENT DOCUMENTS 8,950,554 B2 * 2/2015 Niikawa ..... B66B 5/044 187/305
9,359,173 B2 6/2016 Dube
9,517,918 B2 12/2016 Dube et al.
2006/0289241 A1 * 12/2006 Okamoto ..... B66B 1/3492 187/292
2007/0000736 A1 * 1/2007 Shikai ..... B66B 5/0037 187/393
2007/0029141 A1 * 2/2007 Chida ..... B66B 5/0031 187/393
2007/0056806 A1 * 3/2007 Okamoto ..... B66B 5/06 187/290
2007/0062763 A1 * 3/2007 Shiratsuki ..... B66B 1/3492 187/394
2007/0089938 A1 * 4/2007 Ishioka ..... B66B 7/08 187/391
2011/0272217 A1 * 11/2011 Niikawa ..... B66B 5/044 187/305
2012/0312638 A1 * 12/2012 Muller ..... B66B 5/044 187/287
2013/0098711 A1 * 4/2013 Aguado ..... B66B 5/044 187/373
2015/0136544 A1 * 5/2015 Dube ..... B66B 5/044 188/180
2018/0029828 A1 * 2/2018 Shi ..... B66B 5/044
2018/0044135 A1 * 2/2018 Jimenez-Gonzalez ..... B66B 5/044
2018/0118515 A1 * 5/2018 Shi ..... B66B 5/04
2018/0201480 A1 * 7/2018 Shi ..... F16D 7/00
2019/0047820 A1 * 2/2019 Cao ..... B66B 5/04
2019/0127180 A1 * 5/2019 Shi ..... B66B 5/044
2020/0102190 A1 * 4/2020 Shi ..... B66B 1/26

FOREIGN PATENT DOCUMENTS

CN 205222339 U 5/2016
CN 206266033 U 6/2017
CN 108002168 A 5/2018
CN 109969898 A * 7/2019 ..... B66B 5/044
EP 1770044 A1 4/2007
EP 1798183 B1 1/2013
EP 3476788 A1 * 5/2019 ..... B66B 1/30
EP 3480831 A1 * 5/2019 ..... B66B 5/044
EP 3505481 A1 * 7/2019 ..... B66B 5/044
EP 3628627 A1 * 4/2020 ..... B66B 1/26
JP 4326255 B2 9/2009
WO 2016142557 A1 9/2016
WO 2017064745 A1 4/2017

* cited by examiner

GOVERNOR ASSEMBLY AND ELEVATOR SYSTEM

FOREIGN PRIORITY

This application claims priority to Chinese Patent Application No. 201711031853.1, filed Oct. 30, 2017, and all the benefits accruing therefrom under 35 U.S.C. § 119, the contents of which in its entirety are herein incorporated by reference.

TECHNICAL FIELD

The present invention relates to the technical field of elevator governors, and in particular, to a governor for a car mounted elevator and an elevator system having the same.

BACKGROUND ART

As technologies for elevator governor assemblies develop, new Car Mounted Governor (CMG) assemblies are more widely applied. Compared with the conventional design in which a governor is mounted at the top of a hoistway in a governor assembly with or without a machine room, a CMG is mounted on an elevator car and moves vertically along with the car. The CMG has a more compact structure and is suitable for a limited hoistway space. The Patent US2013/0098711A1 published by Aguado et al. on Apr. 25, 2013 disclosed a CMG, and the patent is incorporated here by reference in its entirety. When the rotating speed of a sheave exceeds a first limit value, the governor assembly invented by Aguado et al. can expand a centrifugal block support rotating together with the sheave, to trigger an electrical switch to cut off the electricity. When the rotating speed of the sheave exceeds a second limit value greater than the first limit value, a roller on the inner side of a connecting rod of a centrifugal mechanism of the governor assembly will be jointed to a core ring, such that the core ring is driven by the sheave and triggers a safety apparatus associated with the core ring, and therefore the safety apparatus can generate mechanical friction with a rail to brake the car. In such a CMG, the governor assembly further includes a remote triggering apparatus. The remote triggering apparatus can be controlled actively to act on the centrifugal mechanism, such that the governor assembly can be triggered actively even that the car is not overspeed, so as to be used in, e.g., a test. The existing remote triggering apparatus is mainly composed of an electromagnet, and a tail end of a column of the electromagnet directly acts on a plastic-made centrifugal block support of the centrifugal mechanism.

In previous applications, the CMGs are generally applied to low-speed elevators. The Chinese Utility Model Patent No. ZL201621141734.2 filed by the Otis Elevator Company on Oct. 20, 2016 and entitled "REMOTE TRIGGERING APPARATUS, GOVERNOR ASSEMBLY AND ELEVATOR" disclosed a remote triggering apparatus. A contact having a smooth transitional surface is adopted in the remote triggering apparatus, such that a CMG is tried to be applied to a high-speed elevator. The patent is incorporated here by reference in its entirety.

SUMMARY OF THE INVENTION

The present invention is directed to solve or at least alleviate the problems in the prior art; According to some aspects, the present invention is further directed to provide a possibility of applying a car mounted governor to a high-speed elevator; According to some aspects, the present invention is further directed to provide a governor assembly that is easily triggered remotely; According to some aspects, the present invention is further directed to provide a governor assembly of which a ratio of a first limit value to a second limit value can be easily adjusted; and According to some aspects, the present invention is further directed to provide a governor assembly with a compact structure.

According to some embodiments, the present invention provides a governor assembly for an elevator system, including: a stationary shaft; a sheave arranged on the stationary shaft and rotatable on the stationary shaft; a core ring arranged on one side of the sheave on the stationary shaft and associated with a safety apparatus; and a lock mechanism including a plurality of rockers, wherein each rocker includes a first end pivotably connected to the sheave and a second end connected to a respective roller, the plurality of rockers are connected by connecting rods such that the plurality of rockers are pivoted synchronously between a first position where the respective roller is separated from the core ring and a second position where the respective roller is jointed to the core ring, and in the second position, each roller rotates along with the sheave to drive the core ring, thus triggering the mounting apparatus.

In another aspect, an elevator system is provided, and the elevator system includes the governor assembly according to the embodiments of the present invention.

BRIEF DESCRIPTION OF THE DRAWINGS

Content disclosed in the present invention will be more easily understood with reference to the accompanying drawings. It should be easily understood by those skilled in the art that these accompanying drawings are merely used for illustration rather than limiting the protection scope of the present invention. Moreover, similar numerals in the drawings are used to represent similar components, wherein.

DETAILED DESCRIPTION

It is easily understood that those of ordinary skill in the art can propose various interchangeable structural modes and implementation manners without changing the essential spirit of the present invention. Therefore, the following specific implementation manners and accompanying drawings are exemplary illustrations of the technical solutions of the present invention and should not be considered as all of the present invention or considered as definitions or limitations to the technical solutions of the present invention.

Orientation terms such as upper, lower, left, right, front, rear, front, back, top, and bottom that are or might be mentioned in the specification are used for definition with respect to constructions shown in the accompanying drawings, and they are relative concepts and are possibly changed correspondingly according to their different positions and different use states. Therefore, these or other orientation terms should not be construed as limitative terms.

Figure 1:
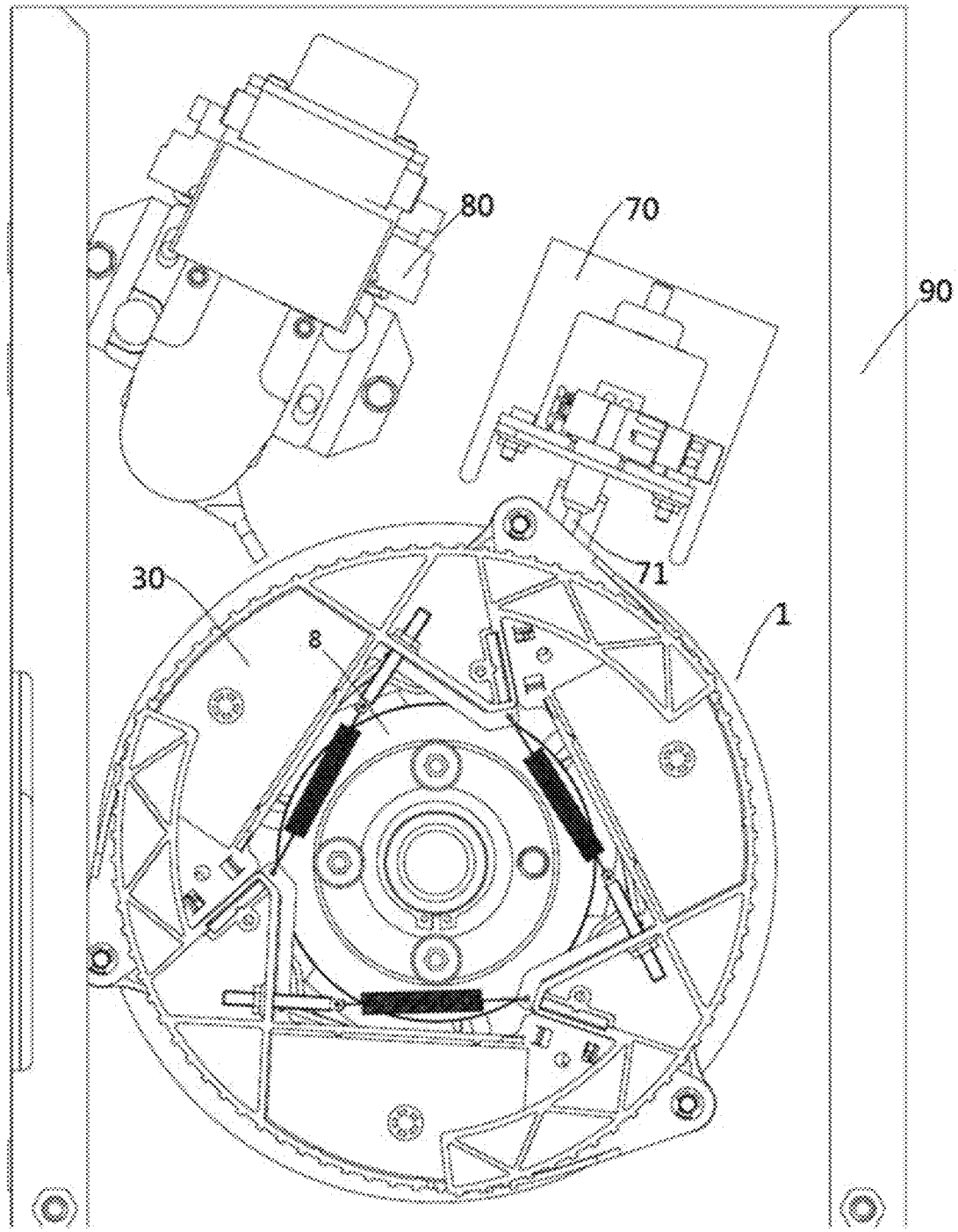
FIG. 1 shows a front view of a governor assembly according to an embodiment.
Figure 2:
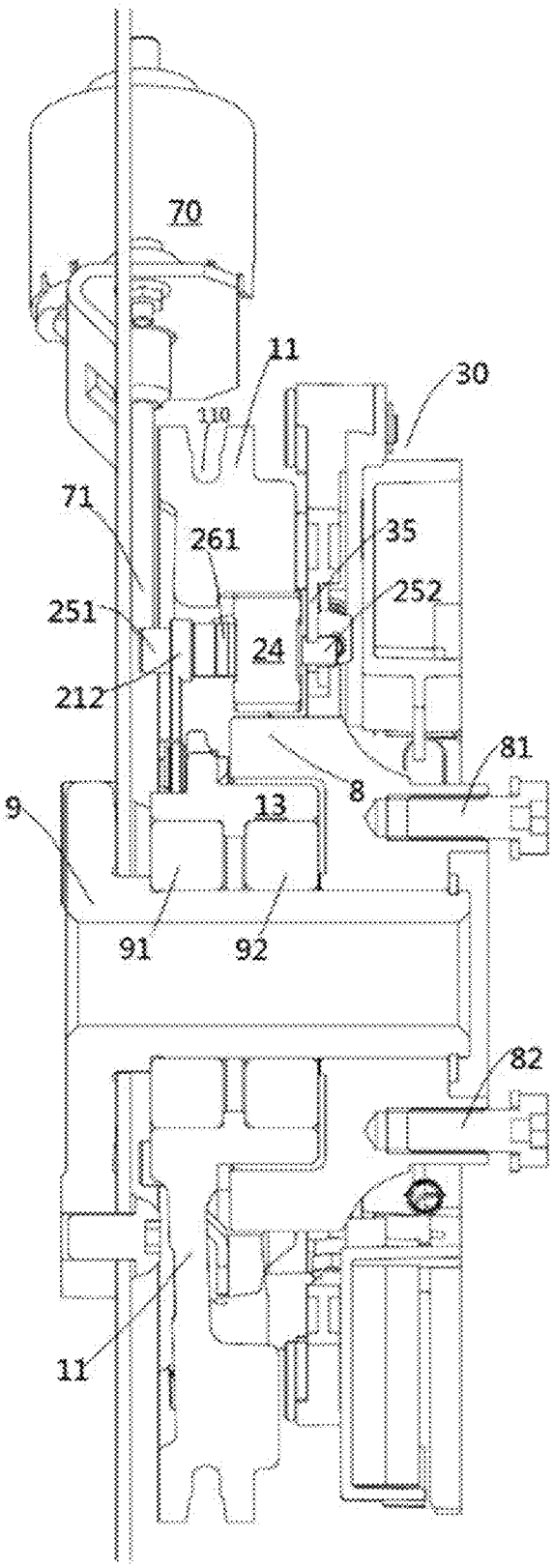
FIG. 2 shows a central longitudinal cross-sectional view of the governor assembly in FIG. 1.

FIG. 1 and FIG. 2 show schematic views of a governor assembly according to an embodiment. The governor assembly mainly includes a stationary shaft 9, a sheave 11, a core ring 8, a lock mechanism 20, a centrifugal mechanism 30, a remote triggering apparatus 70, an electrical safety switch 80, and so on. As more clearly shown in FIG. 2, the sheave 11 is arranged on the stationary shaft 9 and is rotatable on the stationary shaft 9. For example, the sheave 11 can be arranged on the stationary shaft 9 through two ball bearings 91 and 92. A sheave groove 110 is disposed on the periphery of the sheave 11 such that the sheave 11 can rotate as the car moves, and the rotating speed and direction of the sheave 11 is related to the movement of the car. The core ring 8 is arranged on one side of the sheave 11 on the stationary shaft 9, that is, the front side of the sheave 11 in the drawing. In some embodiments, the core ring 8 has a recess to partially enclose a front inner ring 13 of the sheave. The front side of the core ring 8 can be associated with a safety apparatus. For example, the core ring 8 can be connected to a rocker arm (not shown) through bolts 81 and 82, and when the core ring 8 rotates, the rocker arm can be driven, and the safety apparatus is started. In some embodiments, the safety apparatus can be an apparatus such as safety tongs capable of being frictionally jointed to a rail of the elevator to brake the car of the elevator. The centrifugal mechanism 30 can be disposed on the front side of the sheave 11, and a specific structure of the centrifugal mechanism is described in detail in the following. As the speed of the elevator (corresponding to the rotating speed of the sheave) reaches a first predetermined value, the centrifugal mechanism will be expanded due to the centrifugal force and an outer ring of the centrifugal mechanism will contact the electrical safety switch 80, so as to cut off the power supply to an elevator traction system to brake the elevator. If the speed of the elevator is not reduced but is increased continuously and reaches a second predetermined value, the lock mechanism 20 of the governor assembly functions, that is, a roller 24 of the lock mechanism 20 is jointed to the core ring 8, such that the roller 24 drives the core ring 8 to rotate to start the mounting apparatus, thus braking the elevator mechanically. The specific structure of the lock mechanism 20 will also be described in detail in the following. In addition, the governor assembly further provides a remote triggering apparatus 70. The remote triggering apparatus 70 can trigger the governor even that the elevator is not overspeed, so as to perform a test, for example, testing whether the governor and/or the mounting apparatus work/works normally. The triggering apparatus 70 can be an electromagnetic switch based on the electromagnetic effect and has an extension portion 71 that can perform linear displacement.

Figure 5:
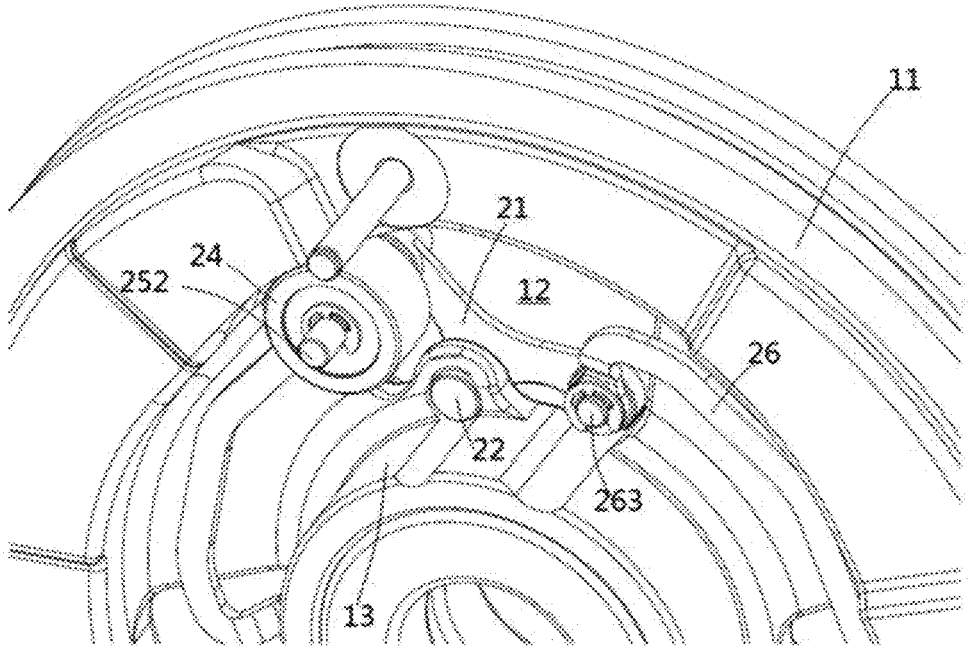
FIG. 5 shows a partial three-dimensional view of a front side of a sheave and a lock mechanism on the sheave according to an embodiment.
Figure 6:
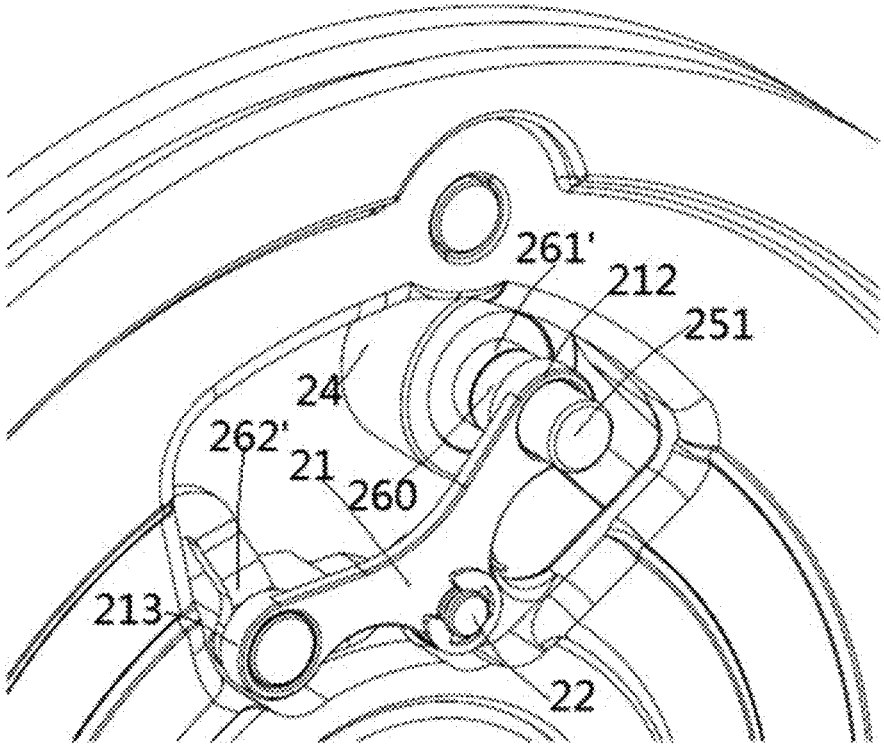
FIG. 6 shows a partial three-dimensional view of a rear side of a sheave and a lock mechanism on the sheave according to an embodiment.
Figure 7:
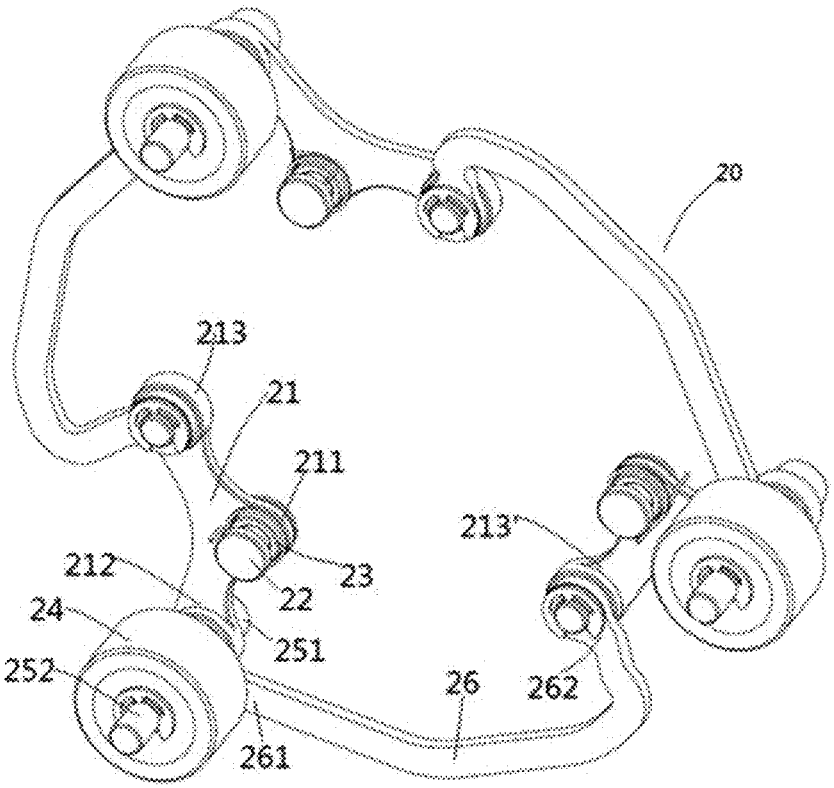
FIG. 7 shows an individual lock mechanism.
Figure 8:
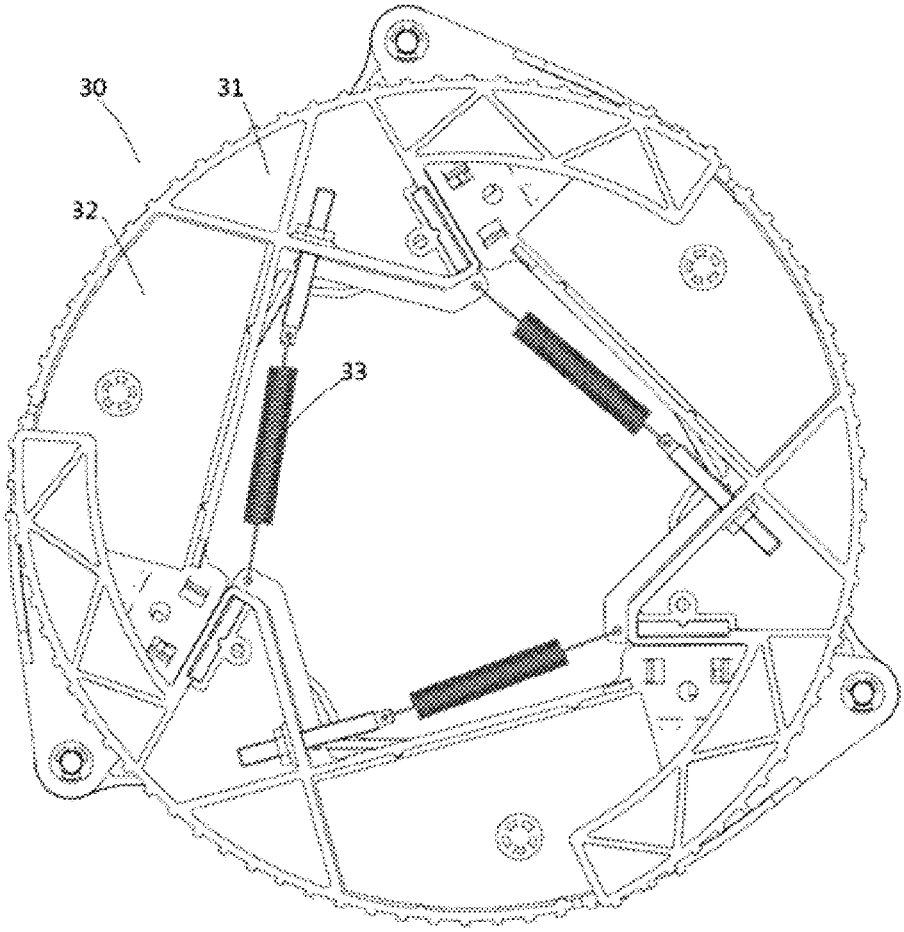
FIG. 8 shows a front view of a centrifugal mechanism according to an embodiment that is at a contraction position.

The specific structure of the lock mechanism is described in detail now with reference to FIG. 3 to FIG. 7. FIG. 7 more clearly shows an individual lock mechanism 20. In the embodiment shown in the drawings, the lock mechanism 20 includes three rockers 21. In an alternative embodiment, the number of the rockers of the lock mechanism is variable. The three rockers 21 each include a first end 211 that is pivotably connected to a corresponding position on the sheave 11 and a second end 212 that is connected to the roller 24. The three rockers 21 are connected by connecting rods 26 such that the three rockers 21 are synchronized. Each rocker 21 can switch, through pivoting around the first end 211, between a first position where the roller 24 is separated from the core ring 8 and a second position where the roller 24 is jointed to the core ring 8. In the second position, the roller 24 at the second end of each rocker 21 that rotates along with the sheave 11 drives the core ring 8 to rotate to start the safety apparatus. In some embodiments, the first end 211 of the rocker 21 is pivotably connected to the sheave 11 through a pin 22 and a reset spring 23. In the embodiment shown in the drawing, the three rockers 21 are distributed uniformly along the circumference of the sheave, and the first ends 211 of the rockers 21 are pivoted to different positions of the same circumference of the sheave 11, that is, the connection positions of the first ends 211 of the rockers 21 and the sheave are distributed uniformly along a circumference with the center of circle of the sheave as the center of circle and a specific distance R as the radius.

Figure 3:
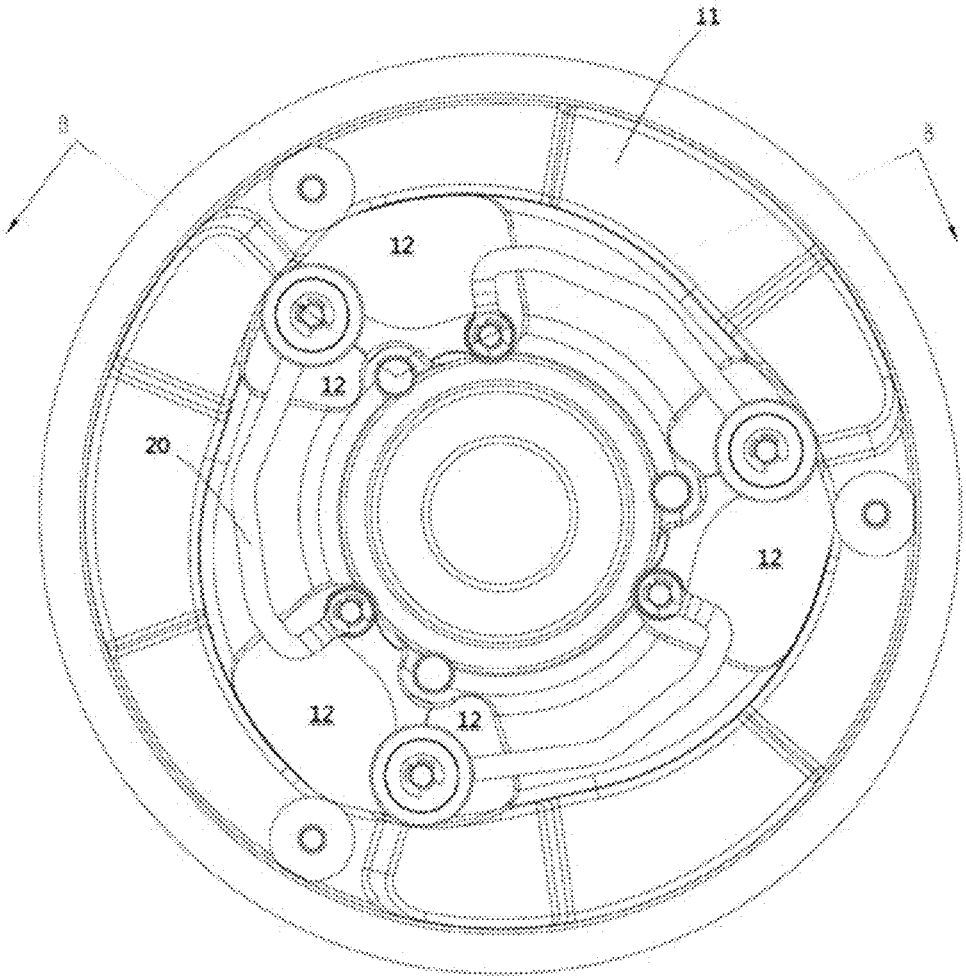
FIG. 3 shows a front view of a sheave and a lock mechanism on the sheave according to an embodiment.
Figure 4:
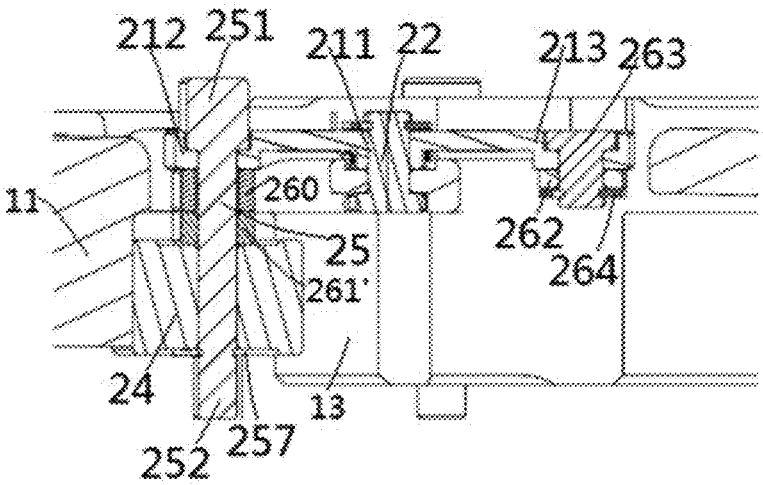
FIG. 4 shows a partial cross-sectional view of a B-B section marked in FIG. 3 according to an embodiment.

In a preferred embodiment, each rocker 21 can be Y-shaped. The Y-shaped rocker 21 has three end portions 213, and a third end portion 213' of an adjacent rocker 21 is connected to the second end 212 of the rocker through a connecting rod 26. In an alternative embodiment, the rocker 21 can also have other shapes, and the connecting rod 26 can also connect adjacent rockers 21 in other suitable manners. Further, as more clearly shown in the embodiment of FIG. 4, in some embodiments, the second end 212 of the rocker 21 is connected to the roller 24 through a support shaft 25. In an alternative embodiment, the second end of the rocker 21 can also be connected to the roller 24 directly or through other structures. Referring to FIG. 4 to FIG. 6, in some embodiments, the first end 211 of the rocker 21 is connected to the rear side of the sheave 11 through the pin 22 and the reset spring 23, the second end 212 of the rocker 21 is connected to the support shaft 25, the support shaft 25 passes through an opening 12 on the sheave 11 and extends to the front side of the sheave 11, and the roller 24 is mounted on the support shaft 25 in a position aligned with the core ring 8. The core ring 8 is not shown in these views and is located on a radial outer side of the front inner ring 13 of the sheave in FIG. 5. In some embodiments, the support shaft 25 has a first end 251 located at the front side of the sheave and a second end 252 located at the rear side of the sheave. In some embodiments, a second end 26 of the connecting rod 26 passes through the opening 12 on the sheave 11 at the third end 213 of the rocker 21, extends from the front side of the sheave 11, and is connected to the second end 212 of the adjacent rocker 21 at a first end 261 of the connecting rod 26, specifically connected to a position in the middle of the support shaft 25 and close to the roller 24. As clearly shown in the cross-sectional view in FIG. 4, in some specific embodiments, the first end 211 of the rocker 21 is connected to the rear side of the sheave 11 through the pin 22, the second end 212 of the rocker 21 has an opening, and the support shaft 25 is inserted into the opening of the second end 212 of the rocker 21. The first end 251 of the support shaft 25 has a slightly expanded diameter and is located at the rear side of the sheave 11. A lining 260 is subsequently connected to the support shaft 25, a second end 261' of the connecting rod 26 follows the lining 260, and the roller 24 follows the second end 261' of the connecting rod 26. The roller 24 is positioned on the support shaft 25 by a card 257, and the second end 252 of the support shaft 25 is exposed and located at the front side of the sheave 11. In addition, the third end 213 of the rocker 21 is connected to a shaft 263 which is further connected to the second end 262 of the connecting rod 26, and the second end 262 of the connecting rod is positioned by a card 264. Referring to FIG. 3, the lock mechanism 20 according to each embodiment is entirely mounted to the sheave 11, and each rocker of the lock mechanism 20 can rotate about a respective pivotal axis, such that the overall lock mechanism 20 can rotate relative to the sheave 11.

Figure 9:
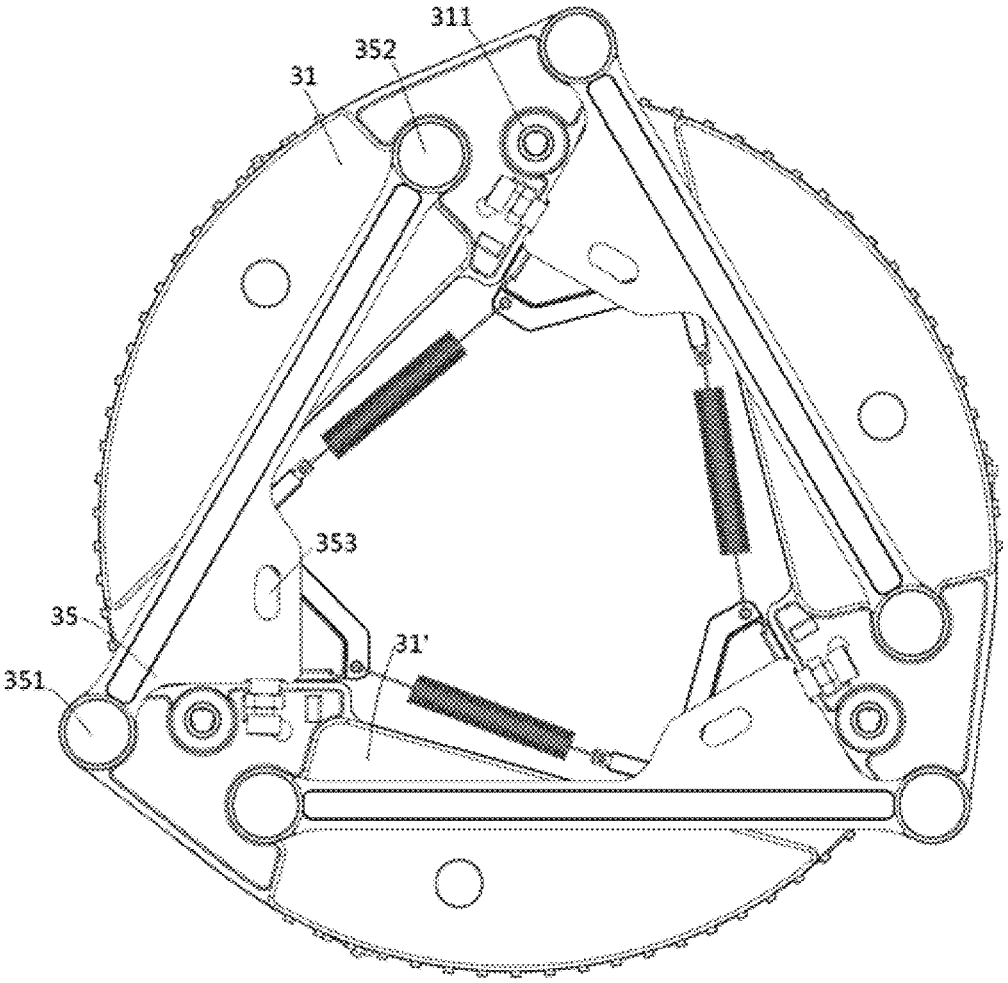
FIG. 9 shows a rear view of a centrifugal mechanism according to an embodiment that is at a contraction position.
Figure 10:
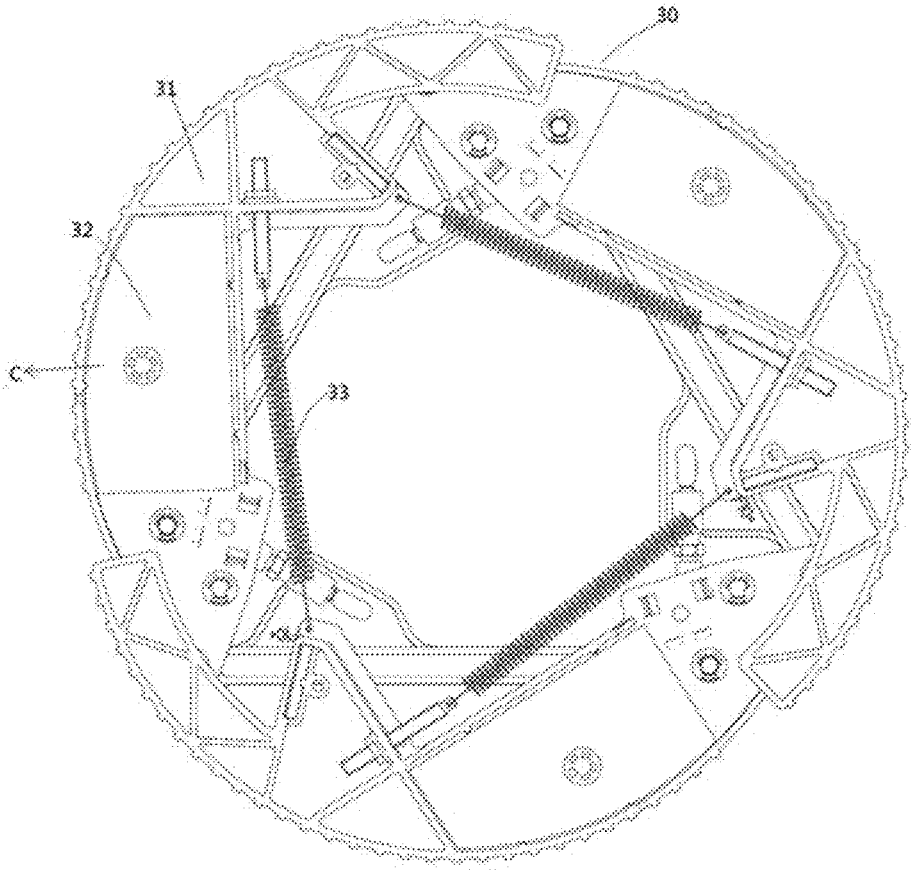
FIG. 10 shows a front view of a centrifugal mechanism according to an embodiment that is at an expansion position.

The centrifugal mechanism 30 according to an embodiment of the present invention is described below with reference to FIG. 8 to FIG. 11. The centrifugal mechanism 30 includes a plurality of centrifugal block supports 31 that are pivotably fixed on the front side of the sheave 11. FIG. 9 shows a pivotal center 311 of the plurality of centrifugal block supports 31. The plurality of centrifugal block supports 31 are provided with centrifugal blocks 32. Adjacent centrifugal block supports 31 are connected by a centrifugal mechanism connecting rod 35. Specifically, as shown in FIG. 9, a first end 351 of the centrifugal mechanism connecting rod 35 is connected to an end portion of a centrifugal block support 31', and a second end 352 of the centrifugal mechanism connecting rod 35 is connected to an end portion of an adjacent centrifugal block support 31. The centrifugal mechanism further includes a retaining mechanism for retaining the plurality of centrifugal block supports at a contraction position, e.g., a tension spring 33 between the centrifugal block supports as shown in the drawings, or a magnetism-based retaining mechanism may be adopted alternatively. The centrifugal mechanism 30 rotates as the sheave 11 rotates, and when the rotating speed of the sheave 11 is increased, the centrifugal mechanism 30 has a tend towards an expansion position shown in FIG. 10 under the drive of the centrifugal force. In an expansion process of the centrifugal mechanism 30, the centrifugal block support 31 will contact and trigger the electrical safety switch 80. A specific embodiment of the centrifugal mechanism 30 is shown in FIG. 8 to FIG. 11; however, in alternative solutions, the lock mechanism 20 of the present invention can be combined in use with any centrifugal mechanisms 30 including existing ones and to-be-developed ones.

Figure 11:
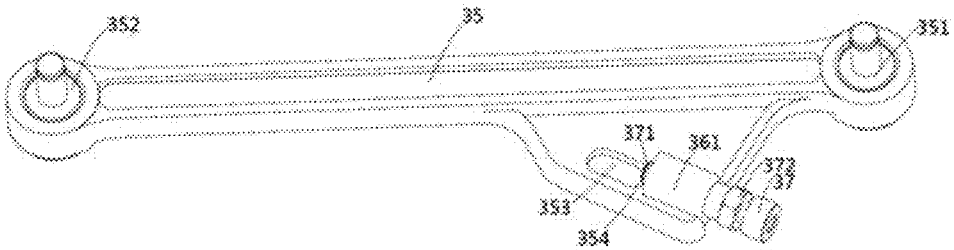
FIG. 11 shows a three-dimensional view of a connecting rod of a centrifugal mechanism according to an embodiment.

In some embodiments, the lock mechanism 20 of the present invention is correlated with the centrifugal mechanism 30. In some embodiments, the support shaft 25 of the lock mechanism 20 is connected to the centrifugal mechanism 30, such that the centrifugal mechanism 30 can drive the lock mechanism 20 to rotate. In some embodiments, the second end 252 of the support shaft 25 of the lock mechanism is connected to the centrifugal mechanism 30, e.g., the connecting rod 35 of the centrifugal mechanism 30. Alternatively, the lock mechanism 20 can also be related to the centrifugal mechanism 30 in other manners. For example, the lock mechanism 20 can be connected to the centrifugal mechanism 30 by means of another position such as the second end 212, or the support shaft 25 can also be connected to another position on the centrifugal mechanism 30, e.g., on the centrifugal block support, as long as the centrifugal mechanism 30 is coupled to the lock mechanism 20 in the expansion process and drives the roller 24 of the lock mechanism 20 to be jointed to the core ring 8. In some embodiments, a notch 353 is formed on the connecting rod 35 of the centrifugal mechanism 30, and the second end 252 of the support shaft 25 is fitted in the notch 353 of the centrifugal mechanism connecting rod 35 and is movable along the notch 353. In some embodiments, the notch 353 of the centrifugal mechanism connecting rod 35 has an arc shape corresponding to a track of the second end 252 of the support shaft 25 when the rocker 21 pivots. That is, the notch 353 is corresponding to a track of the second end 252 of the support shaft 25 when the rocker 21 pivots about the shaft 22. Definitely, in an alternative embodiment, the notch 353 can be opened to at least include the track, for example, the notch can be opened to be longer and wider than the track, or the like. In some embodiments, an initial position 354 of the notch 353 on the centrifugal mechanism connecting rod 35 is adjustable. FIG. 11 shows a method of simply adjusting the initial position 354 of the notch 353. In some embodiments, a first end of the notch 353 of the centrifugal mechanism corresponding to the initial position is provided with a bolt hole 361, and a bolt 37 is fitted into the bolt hole and can be extended into the notch. Moreover, the initial position 354 of the notch 353 is adjusted by the length of the bolt 37 inserted into the notch 353. Optionally, a nut 372 can be used to position the bolt 37. Definitely, in an alternative embodiment, the initial position 354 of the notch 353 can also be adjusted by adopting any other suitable method, for example, adding any obstacle at one end of the notch 353, such as inserting a rubber plug at one end of the notch 353.

Figure 12:
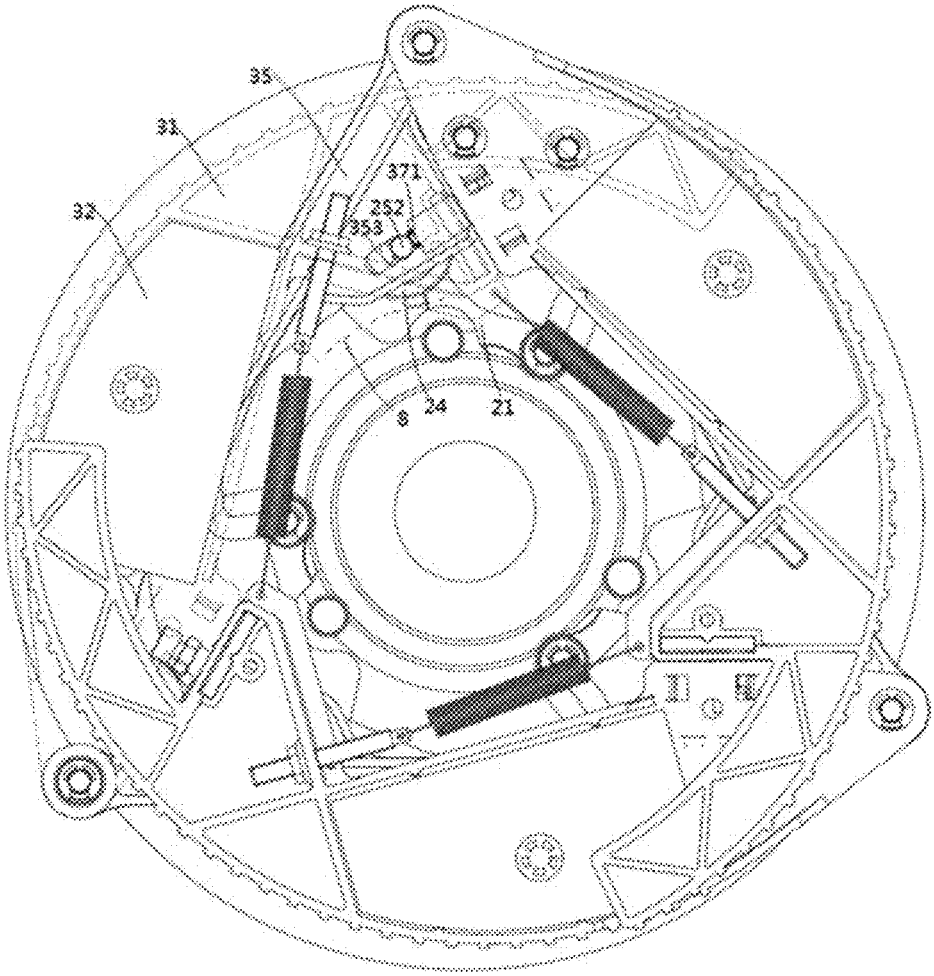
FIG. 12 shows a front view of a sheave, a lock mechanism, and a centrifugal mechanism that are combined and at a contraction position according to an embodiment.
Figure 13:
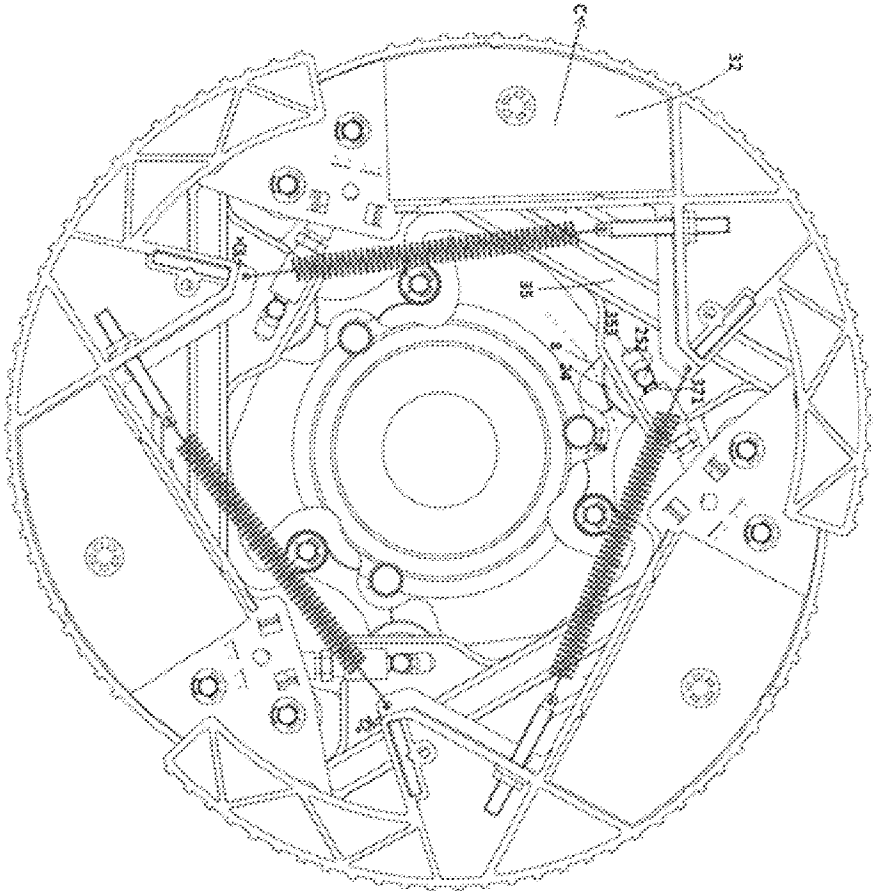
FIG. 13 shows a front view of a sheave, a lock mechanism, and a centrifugal mechanism that are combined and at an expansion position according to an embodiment.

How the governor assembly of the present invention is triggered is understood with reference to FIG. 12 and FIG. 13. In FIG. 12, a clockwise rotation direction of the sheave corresponds to the downward direction of the elevator car. FIG. 12 shows that the governor assembly is not overspeed and the centrifugal mechanism 30 is at a contraction position. In the drawing, the centrifugal block support 31 at the left side is drawn with dotted lines such that its internal structure is visible. The second end 252 of the support shaft 25 is located in the notch 353 of the centrifugal mechanism connecting rod 35 and is located at the initial position of the notch 353 and abuts against the end portion of the bolt 371. The initial position of the notch 353 can be adjusted by tightening or loosening the bolt 371. In FIG. 11, the position of the core ring 8 is drawn with dotted lines. When the centrifugal mechanism 30 is in the contraction position, the rocker 21 is located in the first position where the roller 24 is separated from the core ring 8. When the rotating speed of the sheave 11 exceeds a first predetermined value, the centrifugal block support 31 of the centrifugal mechanism 30 will trigger the electrical safety switch 80. When the rotating speed of the sheave 11 exceeds a second predetermined value, the centrifugal block 32 of the centrifugal mechanism 30 is expanded to the expansion position shown in FIG. 13 under the drive of the centrifugal force C. The notch 353 of the connecting rod 35 of the centrifugal mechanism 30 drives the second end 252 of the support shaft 25 in the notch, so as to drive the rocker 21 to pivot from the first position where the roller 24 is separated from the core ring 8 to the second position where the roller 24 is jointed to the core ring 8. As shown in FIG. 13, the rocker 21 has been pivoted to the second position, and the roller 24 has been jointed to the core ring 8 and will drive the core ring 8, thereby triggering the safety apparatus.

Figure 14:
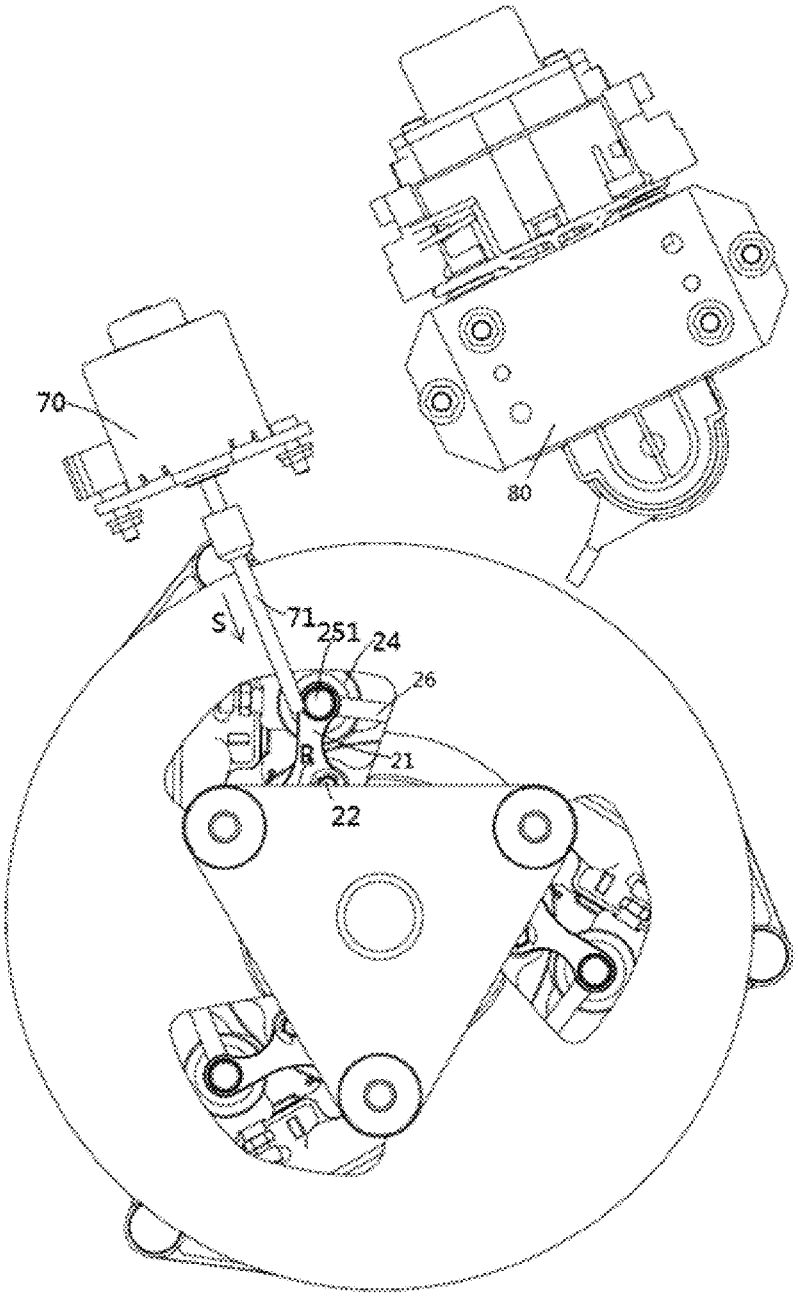
FIG. 14 shows a rear view of a governor assembly according to an embodiment when being triggered by a remote triggering apparatus.
Figure 15:
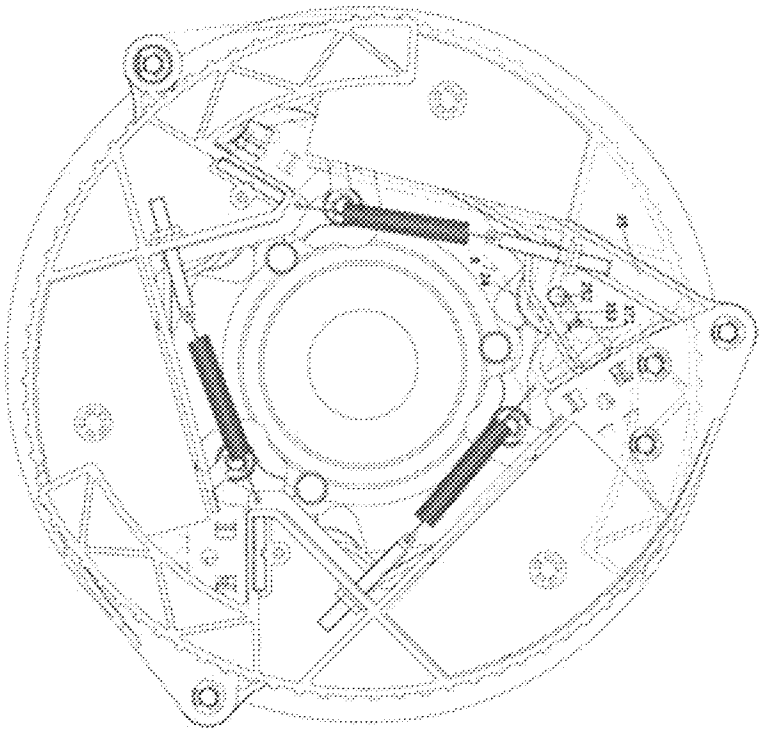
FIG. 15 shows a front view of a governor assembly according to an embodiment when being triggered by a remote triggering apparatus.

How to actively trigger the governor assembly of the present invention is understood with reference to FIG. 14 and FIG. 15. When remote triggering is required, the extension portion 71 of the remote triggering apparatus 70 can extend along an S direction in response to, e.g., a control switch of an operating room, and interferes with the lock mechanism 20, such that the plurality of rockers 21 are pivoted to the second position where the roller 24 is jointed to the core ring 8. In some embodiments, the extension portion 71 of the remote triggering apparatus 70 acts on the support shaft 25 of the lock mechanism 20. In some embodiments, the extension portion 71 of the remote triggering apparatus 70 is located at the rear side of the sheave and acts on the first end 251 of the support shaft 25. Definitely, it is alternative that the remote triggering apparatus can also act on another part of the lock mechanism 20 or another part of the support shaft 25. As shown in FIG. 15, as the sheave 11 rotates clockwise, the extension portion 71 of the remote triggering apparatus 70 toggles the first end 251 of the support shaft 25, such that the rocker 21 is pivoted along the shaft 22 to the second position where the roller 24 is jointed to the core ring 8, thereby actively triggering the governor assembly. During rotation of the rocker 21, the second end 252 of the support shaft 25 moves along the notch 353 of the centrifugal mechanism connecting rod 35, such that the lock mechanism 20 rotates independent of the centrifugal mechanism 30, drives the core ring 8, and starts the safety apparatus.

According to another aspect of the present invention, an elevator system having the governor assembly according to the embodiments of the present invention is further provided.

Advantages of the governor assembly and the elevator system of the present invention include, but are not limited to:

Compared with the prior art in which the roller is directly connected to the connecting rod of the centrifugal mechanism 30, the present invention adopts an independent lock mechanism 20 and an independent centrifugal mechanism 30. On one hand, the position of the lock mechanism 20 relative to the centrifugal mechanism 30 can be adjusted by adjusting the initial position of the notch 353, thereby adjusting the second predetermined value of the mechanical triggering speed of the governor. Standards in the art have restrict specifications on a ratio of the first predetermined value to the second predetermined value of the triggering speed of the governor, and therefore, extremely high requirements have been put forward for the manufacturing precision (such as tolerance) of parts of the governor. Using the governor assembly of the present application can reduce the requirement on the part precision, and the ratio of the first predetermined value to the second predetermined value is implemented through subsequent adjustment, thereby meeting the standards.

On the other hand, compared with the technical solution in the prior art in which the remote triggering apparatus directly acts on the connecting rod of the centrifugal mechanism 30, the remote triggering apparatus of the present invention acts on the lock mechanism 20. When the governor assembly is actively triggered through the remote triggering apparatus, as the lock mechanism 20 is pivotable independent of the centrifugal mechanism 30 and the weight and the rotational inertia of the lock mechanism 20 are small, no great impact will be generated when the remote triggering apparatus contacts the lock mechanism 20, e.g., the first end 251 of the support shaft 25. Therefore, the governor assembly according to the present invention can be applied to a high-speed elevator system. In the high-speed elevator system, the centrifugal mechanism has a large rotational inertia, and if the remote triggering apparatus directly acts on the centrifugal mechanism, the plastic-made centrifugal mechanism may be broken, and a core column of the electromagnetic switch may be shocked or even retracted.

Finally, in the governor assembly of the present invention, the lock mechanism 20 and the centrifugal mechanism 30 are skillfully arranged on two sides of the sheave and are correlated through the opening of the sheave, such that the whole governor assembly is compact in structure.

The specific embodiments described above are merely used to describe the principles of the present invention more clearly, and components are clearly shown or described such that the principles of the present invention are more easily comprehensible. Those skilled in the art can easily make various modifications or changes on the present invention without departing from the scope of the present invention. Therefore, it should be understood that these modifications or changes should all be encompassed in the patent protection scope of the present invention.

What is claimed:

1. A governor assembly for an elevator system, comprising:

a stationary shaft;

a sheave arranged on the stationary shaft and rotatable on the stationary shaft;

a core ring arranged on one side of the sheave on the stationary shaft and associated with a safety apparatus; and a lock mechanism comprising a plurality of rockers, wherein each rocker comprises a first end pivotably connected to the sheave and a second end connected to a respective roller, the plurality of rockers are connected by connecting rods such that the plurality of rockers can be pivoted synchronously between a first position where the respective roller is separated from the core ring and a second position where the respective roller is jointed to the core ring, and in the second position, each roller rotates along with the sheave to drive the core ring, thus triggering the safety apparatus.

2. The governor assembly according to claim 1, wherein the first end of the rocker is pivotably connected to the sheave through a pin and a reset spring.

3. The governor assembly according to claim 1, wherein the plurality of rockers comprise three or more rockers, and the first ends of the plurality of rockers are pivotally connected to a circumference that is located on the sheave and at the same distance from the center of rotation of the sheave, and distributed uniformly along the circumference.

4. The governor assembly according to claim 1, wherein the rocker is Y-shaped, the rocker further has a third end, and the third end of the rocker is connected to a second end of an adjacent rocker through a connecting rod.

5. The governor assembly according to claim 1, further comprising a remote triggering apparatus that acts on the lock mechanism such that the plurality of rockers are pivoted to the second position.

6. The governor assembly according to claim 1, wherein the second end of the rocker is connected to the roller through a support shaft.

7. The governor assembly according to claim 6, wherein the first end of the rocker is connected to the rear side of the sheave, the second end of the rocker is connected to the support shaft, the support shaft passes through an opening on the sheave and extends to the front side of the sheave, and the roller is mounted on the support shaft and aligned with the core ring.

8. The governor assembly according to claim 7, wherein the connecting rod passes through the opening and extends to the front side of the sheave.

9. The governor assembly according to claim 6, further comprising a remote triggering apparatus that acts on the support shaft of the lock mechanism.

10. The governor assembly according to claim 9, wherein the support shaft of the second end of the rocker has a first end located at the rear side of the sheave, and the remote triggering apparatus acts on the first end of the support shaft.

11. The governor assembly according to claim 9, wherein the remote triggering apparatus is an electromagnetic switch at the rear side of the sheave, and the electromagnetic switch has an extension portion capable of performing linear displacement.

12. The governor assembly according to claim 6, wherein the support shaft is connected to a centrifugal mechanism of the governor assembly.

13. The governor assembly according to claim 12, wherein the support shaft of the second end of the rocker has a second end located at the front side of the sheave, and the second end of the support shaft is connected to the centrifugal mechanism of the governor assembly.

14. The governor assembly according to claim 13, wherein the second end of the support shaft is fitted in a notch of the centrifugal mechanism of the governor assembly, and the second end of the support shaft is movable along the notch.

15. The governor assembly according to claim 14, wherein the notch of the centrifugal mechanism of the governor assembly is formed into or at least comprises an arc shape corresponding to a track of the second end of the support shaft during movement of the rocker from the first position to the second position.

16. The governor assembly according to claim 14, wherein an initial position of the notch of the centrifugal mechanism of the governor assembly is adjustable.

17. The governor assembly according to claim 16, wherein a first end of the notch of the centrifugal mechanism of the governor assembly corresponding to the initial position is provided with a bolt hole, a bolt is fitted in the bolt hole and is extensible into the notch, and the initial position of the notch is adjusted by the length of the bolt inserted into the notch.

18. The governor assembly according to claim 14, wherein the centrifugal mechanism comprises a plurality of centrifugal block supports pivotably fixed to the front side of the sheave, the plurality of centrifugal block supports are provided with centrifugal blocks, the plurality of adjacent centrifugal block supports are connected by centrifugal mechanism connecting rods, the plurality of supports are retained at a contraction position by a retaining mechanism and have a tend towards an expansion position under the drive of the centrifugal force as the rotating speed of the sheave increases, and the notch is formed on the centrifugal mechanism connecting rod between the plurality of supports.

19. The governor assembly according to claim 18, wherein when the centrifugal mechanism has a tend towards the expansion position under the drive of the centrifugal force, the notch of the connecting rod of the centrifugal mechanism drives the support shaft of the lock mechanism in the notch, thus driving the rocker to pivot from the first position to the second position.

20. The governor assembly according to claim 1, further comprising an electrical safety switch at the radial outer side of the plurality of centrifugal block supports.

21. An elevator system, comprising the governor assembly according to claim 1.

* * * * *